United States Patent [19]

Andre

[11] 4,102,074

[45] Jul. 25, 1978

[54] COUNTING DEVICE IMPULSE ACTIVATOR WITH TORQUE LIMITER

[75] Inventor: William L. Andre, Ben Lomond, Calif.

[73] Assignee: The United States of America as represented by the Secretary of the Army, Washington, D.C.

[21] Appl. No.: 766,310

[22] Filed: Feb. 7, 1977

[51] Int. Cl.[2] ..... F41F 1/00; F41F 27/00; G06M 1/00

[52] U.S. Cl. ..... 42/1 E; 235/91 R; 235/91 H; 235/95 C

[58] Field of Search ..... 42/1 E; 235/91 R, 91 H, 235/95 C, 1 C; 89/1

[56] References Cited

U.S. PATENT DOCUMENTS

| | | | |
|---|---|---|---|
| 1,150,756 | 8/1915 | Gocke | 42/1 E |
| 1,324,098 | 12/1919 | Arter | 42/1 E |
| 1,382,913 | 6/1921 | Hodge et al. | 235/91 H |
| 1,479,138 | 1/1924 | Hazelton | 42/1 E |
| 1,624,219 | 4/1927 | Cowdrey | 235/91 H |
| 2,207,204 | 7/1940 | Peyton et al. | 235/91 H |
| 3,130,906 | 4/1964 | Fischer | 235/91 R |

FOREIGN PATENT DOCUMENTS

| | | | |
|---|---|---|---|
| 137,645 | 1/1920 | United Kingdom | 42/1 E |

*Primary Examiner*—Stephen J. Tomsky
*Attorney, Agent, or Firm*—Nathan Edelberg; Robert P. Gibson; Robert O. Richardson

[57] ABSTRACT

This invention comprises an actuator for a mechanical counting device for recording and storing data. This actuator includes a weight having an eccentric center of mass which is freely pivotable in one plane within preset limits in response to an externally applied impulse force of a predetermined magnitude to apply a torque force within prescribed limits to a shaft which, upon rotation thereof under the influence of such torque force, actuates the counter mechanism to record a count. Means are provided to apply counter torque force of a constant predetermined magnitude to the shaft, so that the counter is actuated only in response to a resultant torque force of a predetermined magnitude generated by the impulse. Torque limiting means are also provided to permit operation of the counter within an impulse band or range greater than the band or range achievable without use of such torque limiting means.

4 Claims, 2 Drawing Figures

FIG. 1
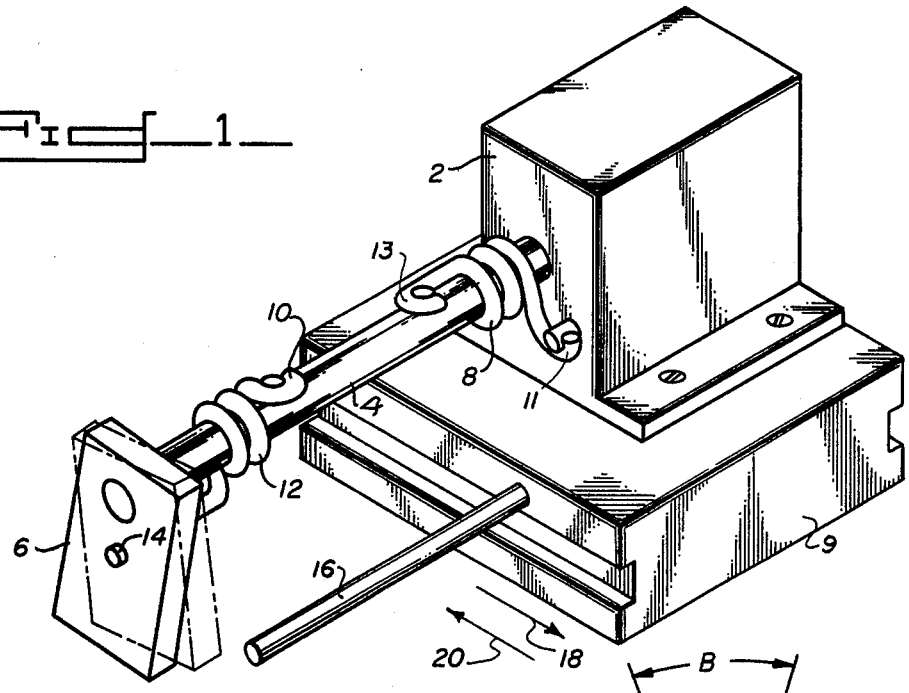
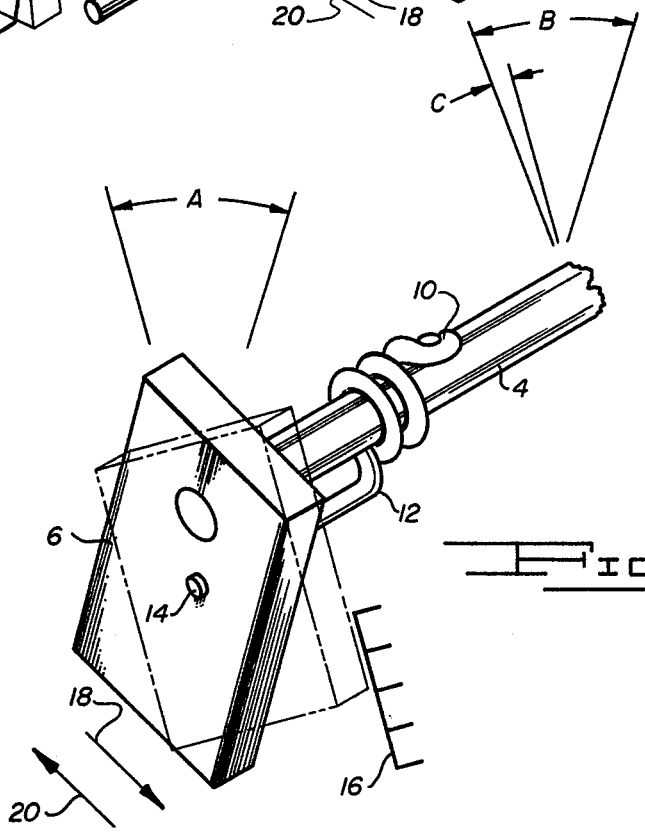
FIG. 2

COUNTING DEVICE IMPULSE ACTIVATOR WITH TORQUE LIMITER

GOVERNMENT RIGHTS

The invention described herein may be manufactured and/or used by or for the Government for governmental purposes without the payment of any royalty thereon.

BACKGROUND OF THE INVENTION

Certain drawbacks of the prior art mechanical counters are detailed in the co-pending application, Counting Device Impulse Activator, Ser. No. 737,867, filed 1 Nov. 1976, of which the present inventor is a co-inventor. Briefly, ruggedization, shock resistance, temperature resistance, attitude insensitivity and minimum recalibration requirements were lacking in these devices. The impulse activated counter of the aforementioned patent application had limited application in use with weapons which fire multiple zones or level of charges. For example, the impulse levels of certain weapons is approximately five times greater at maximum charge loads or zones than at minimum charge loads or zones. The impulse counter of my co-pending application is able to count accurately up to a "*g*" level of approximately 1.5 times that of the threshold level.

SUMMARY OF THE INVENTION

By utilization of the present invention these problems and difficulties, among others, of the prior art are substantially overcome by the provision of a counter actuator assembly comprising an impulse reactive weight or mass operatively connected to a shaft which actuates the counter to count, means to control the amount of torque the mass applies to the counter shaft when the mass is pulsed and means to apply a counter torque force to the shaft to permit the counter to count within an impulse band or range larger than the range or band which can be achieved without the counter torque limiter means. In accordance with the present invention a torque limiting action is provided to limit the torque and resulting energy that can be applied to the counter mechanism. In this manner the impulse counter of my co-pending application, when modified with the torque limiting feature of the present invention, will continue to count accurately at a "*g*" level twenty times greater than the threshold or minimum level at which the counter was set to initiate counting. The concept for the torque limiter is that a properly selected weight with an eccentric center of mass is appropriately attached but not fixed to a counter shaft. The weight transmits the required energy needed to rotate the shaft through a connecting spring between the weight and counter shaft. The method of attachment is such as to constrain the angular motion of the weight with respect to the shaft within determined limits. The weight is attached so that it freely rotates about the shaft within constrained limits if the connecting spring is not attached to the shaft. The weight is then spring loaded with respect to the shaft in such a manner as to retain the weight at a fixed angular position with respect to the shaft or to return the weight to the fixed angular position if any angular displacement from the fixed position occurs within the constraint limits. The fixed angular position is the at-rest position of the weight with respect to the shaft when the two are spring loaded, and coincides with the lower constraint limit of the weight with respect to the counter.

BRIEF DESCRIPTION OF THE DRAWINGS

FIG. 1 is a schematic view in perspective of a preferred embodiment of the present invention.

FIG. 2 is a partial enlarged view of a portion of FIG. 1 illustrating the concept of the present invention.

DESCRIPTION OF THE PREFERRED EMBODIMENT

Referring to FIG. 1 there is shown in block form a conventional mechanical digital counter 2 of the type shown and described in my co-pending application. It has a rotatable actuator shaft 4 for activating a plurality of counts by the counter 2. A properly selected weight or mass 6 is shown rotatably mounted at one end 8 of the shaft 4. The mass 6 is mounted so as to exhibit an eccentric center of mass to permit angular pivoting movement of the mass in a single plane in response to the application of an external impulse force thereto. This impulse force may be from the firing of the weapon, causing rapid rearward movement of receiver 9 in a recoil direction shown by arrow 18. When an impulse force is applied to the weight or mass 6, in the direction of arrow 18 pivoting movement of the mass is translated into a torque force and transmitted to the shaft 4 thereby to rotate the shaft. Rotation of the shaft 4 under the application of an impulse force of a predetermined magnitude actuates the counter to count.

In order to assure that the shaft does not actuate a count unless the amplitude of the impulse applied to the mass 6 exceeds a predetermined threshold value,; i.e., the weapon has been fired a pre-set constant counter torque force is applied to the shaft. For this purpose a pre-loaded spring means 8 is coiled about the shaft 4 and connected to the counter 2 at one end 11 and is fastened at its other end 13 to the shaft 4.

The threshold force value is selected depending upon the impulse function which is to be counted. The appropriate threshold force value to produce a count is established by the amount of preloading of the spring 8 and the torsional spring constant value to the value of preload spring torque. This spring resistance in one direction must be overcome by the impact force in the other direction before mass 6 can rotate the shaft 4. The means for limiting the torque applied to the shaft by the mass 6 is spring means 12 coiled about the shaft 4 adjacent the weight 6. One end 10 of the torque limiting spring means 12 is attached to the shaft 4 and the other end 14 is attached to the weight or mass 6. The weight or mass 6 transmits the torque force needed to rotate the shaft 4 through spring means 12. The spring 12 is attached to the shaft 4 and weight 6 in such a manner as to constrain the angular impulse induced motion of the weight 6 relative to the shaft 4 within predetermined limits. The weight 6 is attached to the shaft 4 so that it freely rotates about the shaft 4 within two extreme positions determined by weight stops 16, one of which is attached to receiver 9 in FIG. 1, and which is illustrated schematically in FIG. 2, if the spring 12 were not attached to the weight 6 and shaft 4. The weight 6 is spring loaded in relation to the shaft 4 in such a manner as to retain the weight 6 located in a fixed angular at-rest position relative to the shaft 4 and to return the weight 6 to the at-rest position in the event angular displacement within the constraint limits from the at-rest position occurs. The angular at-rest position of the weight 6 is the at-rest position of the weight 6 with respect to the shaft when the weight 6 and shaft 4 are spring loaded and coincides with the lower constraint limit of the weight 6 in relation to the counter.

FIG. 2 illustrates conceptually the operation of the shaft torque limiting assembly. Angle A represents the total constrained angle of rotation of the weight from the position shown in full lines through the position shown in dotted lines. Angle B represents the degree of rotation of the shaft in actuating the counter to count. Angle B is approximately equal to but less than Angle A. The difference existing between Angle A and Angle B is indicated by Angle C which represents the amount of rotation occurring between the impulse weight 6 and the counter shaft 4.

When the weight 6 is pulsed, such as by a force in the direction of arrow 18, a torque limiting effect on the shaft 4 is created by limiting the total maximum allowable angular displacement, i.e., Angle A, of the weight by means of a physical stop 16 also identified as the maximum displacement limit in FIG. 1.

OPERATION

In operation, when an impulse is applied to the weight at a force level greater than the minimum required to actuate the counter to count, the shaft 4 will experience an impulse induced torque which is substantially the same as that experienced from an impulse just sufficient to cause counting.

The width of the impulse band or range sufficient to cause uniform counting may be adjusted by making an adjustment in the value of Angle C which represents the difference in torque displacement characteristic existing between the spring means 8 and spring means 12.

The torque exertable by the spring means 8 on the shaft 4 when the weight is at its maximum angular displacement position is pre-set at a value slightly greater than the shaft torque required to cause the counter to perform a counting function. As the difference in torque at the maximum angular displacement position between the torque limiting spring means 12 and the spring loaded shaft 4 is reduced, the impulse band width is lengthened beyond the normal threshold level. The lower limit on torque difference is determined by that difference level below which the torque limiting spring means will not transmit or allow the counter to perform a counting function at the desired threshold level.

This counter may also be made to "cock" when a force is applied in the direction of arrow 18, and then "count" when another force is applied in the opposite direction, that of arrow 20. This method of operation is similar to that described in my co-pending application and prevents a count when the gun parts move into battery position without the gun having been fired. Thus, when the counter 2 is attached to a gun recoil part, such as receiver 9 in FIG. 1, so that it first moves rearwardly in the direction of arrow 18, the impulse weight moves to its position shown in solid lines. This rotates shaft 4 to "cock" the counter 2 preparatory to initiating a click or count. The subsequent counterrecoil movement of the gun part as it moves to battery position moves the counter 2 forward in the direction of arrow 20. This moves the weight 6 relatively rearwardly to its position shown in phantom lines in FIG. 2. This "clicks" the counter 2 to register a count and the weight then returns to its original position. In this mode of operation the counter counts only if the weight has gone through the two steps just mentioned.

Tests on an impulse counter incorporating the torque limiting feature of the present invention counted uniformly at a "*g*" level ("*g*" = 32.2 ft./sec.$^2$) twenty times greater than the threshold at the minimum "*g*" level at which the counter was set to initiate counting. Since the mass of the impulse weight 6 is constant, impulse level and "*g*" level correspond to the same effect for a given time duration of impulse. In contrast, impulse counters which were constructed without the torque limiting feature of this invention counted uniformly up to a "*g*" level of only approximately one and one half times that of the threshold level. As aforesaid, the range of impulse levels on certain gun systems is approximately five times greater at maximum loads and zones than at minimum loads and zones. Application of the torque limiting feature of the present invention to counters will permit round counters to be utilized with such multiple zone or charge weapons.

Thus, the present invention enhances uniformity of counter counts by the provision of means to limit the amount of torque that is applied to the counter within a counter actuating impulse band or range much greater than a counter not utilizing the torque limiting feature of the invention.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. An impulse activated counting device having a counting device impulse activator with torque limiter including:
   - a weight mounted for pivotal movement on a counter actuating shaft,
   - spring means biasing said weight to a pre-set rotary position on said shaft,
   - said shaft being rotatably mounted on said counter for registering rotary movement of said shaft, and
   - a spring interconnecting said shaft and said counter to resiliently resist rotation of said shaft.

2. An impulse activated counting device as in claim 1 wherein said shaft is at right angles to the direction of the impulse being counted.

3. An impulse activated counting device as in claim 1 wherein the weight rotates in a plane parallel to the direction of the impulse being counted.

4. An impulse activated counting device as in claim 1 wherein said counter requires shaft rotation in one direction and a subsequent rotation in the other direction to provide an impulse count.

* * * * *